US006540877B1

(12) United States Patent
Katz et al.

(10) Patent No.: US 6,540,877 B1
(45) Date of Patent: Apr. 1, 2003

(54) INTERNAL PAPER SIZING IMPROVEMENTS

(75) Inventors: Gerald Katz, Charleston, SC (US); Lester William House, Summerville, SC (US); Donald E. Alexander, Sr., North Charleston, SC (US); Susanne L. Sowers, Sparks, MD (US); Joseph Marton, Newtown, PA (US)

(73) Assignee: MeadWestvaco Corporation, Stamford, CT (US)

( * ) Notice: Subject to any disclaimer, the term of this patent is extended or adjusted under 35 U.S.C. 154(b) by 0 days.

(21) Appl. No.: 10/117,970

(22) Filed: Apr. 8, 2002

Related U.S. Application Data

(63) Continuation-in-part of application No. 09/329,842, filed on Jun. 11, 1999, now Pat. No. 6,368,457, which is a continuation-in-part of application No. 09/087,879, filed on Jun. 1, 1998, now abandoned.

(60) Provisional application No. 60/054,733, filed on Aug. 5, 1997.

(51) Int. Cl.[7] ..... D21H 17/62

(52) U.S. Cl. ..... 162/180; 162/183

(58) Field of Search ..... 162/180, 183; 106/218, 238

(56) References Cited

U.S. PATENT DOCUMENTS 6,368,457 B1 * 4/2002 Kraus et al. ..... 162/180

* cited by examiner

*Primary Examiner*—Peter Chin

(74) *Attorney, Agent, or Firm*—Terry B. McDaniel; Daniel B. Reece, IV; Thomas A. Boshinski

(57) ABSTRACT

An improvement is disclosed over conventional internal sizing of stock furnish for papermaking, wherein alum is added to the thick paper stock and the long retention time permits complete reaction with the fibers. The invention process permits successfully adding novel aluminum rosinate size composition unconventionally in thin stock furnish, where retention times are on the order of less that 1 minute. The highly charged aluminum rosinate size is able to be quickly adsorbed onto the fiber surfaces to permit surprisingly efficient sizing in thin stock. The quick sizing avoids concern with rising pH over time (in conventional thick stock application) and increases sizing efficiency.

7 Claims, 4 Drawing Sheets

INTERNAL PAPER SIZING IMPROVEMENTS

The instant application is a continuation-in-part application of commonly owned application Ser. No. 09/329,842 for "Internal Paper Sizing Agent," filed on Jun. 11, 1999 now U.S. Pat. No. 6,368,457, which in turn is a continuation-in-part of commonly owned application Ser. No. 09/087,879 for "Method for Internal Sizing of Paper now abandoned," filed on Jun. 1, 1998, which in turn is based on Provisional Application Serial No. 60/054,733, filed on Aug. 5, 1997.

BACKGROUND OF THE INVENTION

1. Field of the Invention

This invention relates generally to paper size used in the manufacture of paper. More particularly, this invention relates to size used in the manufacture of sized paper wherein the fibrous furnish used to make the paper has high hardness (i.e., an excess of calcium or magnesium ions). The invention further relates to improvements in the sized paper manufacturing process involving size application.

2. Description of Related Art (Including Information Disclosed Under 37 CFR 1.97 and 37 CFR 1.98)

The sizing of paper is an old and well-established art, and a wide variety of materials have been proposed heretofore for this purpose. Sizing agents are typically added to cellulose fibers to impart resistance of the paper to the penetration of liquids. Resistance to liquid penetration is necessary to prevent the paper from breaking down when the paper is exposed to water during the papermaking operation, e.g., passing through a size press starch solution prior to drying. Resistance to liquid is also necessary so that the print quality can be maintained upon application of water-based inks to the paper surface. As is well known, the sizing agent may be applied to the fibers during the papermaking operation, in which case the process is called internal sizing (also known as beater or engine sizing), or it may be applied to the surface of the paper after web formation, in which case it is called external or surface sizing. Internal sizing serves primarily to increase resistance to water penetration; whereas external sizing does that as well as improve other surface properties, such as strength and/or printability. Certain papers, such as those used in aseptic packaging, may be produced via a two step sizing process comprising an internal size step and a surface size step, as taught in U.S. Pat. No. 5,308,441 to Kern.

The sizing agents used in the paper industry cover a wide range of materials, including rosin size (such as aluminum salts of abietic acid), synthetic resins, glue or gelatin (animal-derived) starch or cellulose derivatives, lattices, polyvinyl alcohol, wax emulsions, and many other similar materials. Some of these, such as rosin size, are used exclusively as internal sizing agents, while others, such as polyvinyl alcohol, are used almost entirely as surface sizing agents. Some materials, such as wax, may be applied by either internal or surface sizing procedures. Rosin size and synthetic resins are the two principal materials used for the internal sizing of paper. Other materials may be used only in small quantities. Nevertheless, rosin size remains, by far, the most important internal sizing agent for bleached board products, while for fine paper products, particularly free sheet, synthetic resins are preferred, primarily due to the use of precipitated calcium carbonate in such products.

The difficulties involved in the sizing of calcium carbonate filled papers with the use of common sizing ingredients, such as rosin and alum, have been long recognized.

U.S. Pat. No. 2,114,509 teaches a method for producing sized paper including a filler containing a calcium salt and an acidic precipitant wherein the mixture of furnish and sizing components is maintained out of contact with the outside atmosphere. Under these conditions, the escape from the mixture of substantial quantities of carbon dioxide is prevented. The method is disclosed as being capable of achieving good sizing while substantially eliminating foam. The benefit of carbon dioxide as a sizing enhancer was recognized in U.S. Pat. No. 5,378,322, where the patentee dissolved $CO_2$ in an aqueous vehicle to catalyze the reaction between the alkylketene dimer sizing agent and the cellulose in the papermaking fibers. Also, U.S. Pat. No. 2,195,600 discloses the use of a protective colloid for rosin in a papermaking furnish containing alkaline filler, to protect the rosin prior to being precipitated by alum. The present invention, as herein disclosed, provides a more effective sizing method for high hardness conditions, and is distinguished by the aforesaid prior art by producing a size material by pre-reacting alum and liquid rosin size before the mixture is introduced into the papermaking furnish.

In rosin or soap rosin sizing, papermaking fibers are rendered hydrophobic by precipitating the rosin with alum to produce aluminum rosinate (see article entitled "Chemistry of Rosin Sizing," by Edward Strazdins, TAPPI Journal, January 1981, vol. 64, No. 1, pp. 31–34). As Strazdins pointed out, the rosin-alum sizing system is useful for various practical reasons, including the following:

(a) the aluminum rosinate precipitate is an excellent retention aid, (b) the degree of sizing is easy to control, (c) the handling of rosin size is relatively simple, (d) the problems of repulping waste are minimal, (e) the size is compatible with other wet-end additives, and (f) the costs of sizing with rosin are relatively low.

A significant drawback to the use of rosin or soap rosin size, however, is the reduction of paper strength due to the strong attachment of the aluminum rosinate precipitate to papermaking fibers. Because of this, the size precipitate is not capable of relocating during the web consolidation and interferes with fiber bonding. The efficiency of alum-rosin sizing suffers even more if the papermaking furnish has a high hardness, or contains large amounts of calcium or magnesium ions. The presence of calcium, for example, produces calcium rosinate, which is an inferior sizing agent to aluminum rosinate and, thus, reduces sizing efficiency.

A common method employed for offsetting the negative effect of high hardness on sizing is to use reverse sizing. With this technique, the alum is added to the furnish before the rosin size. Thus, reverse sizing represents an improvement over conventional rosin sizing of high hardness furnish, since the alum is already in the furnish when the rosin size is added. While reverse sizing can lead to some sizing improvement in a high hardness furnish, the alum must still compete with any multivalent cations in the furnish. Accordingly, the present invention is directed to a rosin size material that achieves even further improvement in the sizing of high hardness furnishes, using either standard or reverse sizing methods, than can be achieved even with reverse sizing with conventional rosin size.

An object of the invention of pending application Ser. No. 09/329,842 was to provide an alum-rosin size composition to achieve maximum effectiveness even under high hardness conditions. A further object of said invention, and a benefit to use of the novel invention size material, was to improve the efficiency of alum-rosin sizing systems in high hardness furnishes in order to optimize the amount of size needed to achieve the desired level of sizing. The efficiency of the composition was shown by examples of its addition to the thick stock (~4% consistency) at the normal thick stock addition point, being the machine chest, at pH 4.8, in lieu of the conventional addition of soap size to the machine chest—it being well-known that sizing efficiency is reduced as the pH increases up to ~pH 6.5.

The time of application of the novel composition in thick stock was typical of normal papermaking systems at about 20 minutes prior to headbox discharge. This is conventional practice for soap size as well. The efficiency of the manufacture of the small particle aluminum rosinate size, formed external to the papermaking stock system was taught in the '842 application to be in the avoidance of competing reactions and chemical interferences, allowing the alum to remain free to react with the rosin size.

SUMMARY OF THE INVENTION

The present invention improvement of such technology resides in the ability to add the aluminum rosinate size composition unconventionally in thin stock, where retention times are on the order of less that 1 minute. The novel aluminum rosinate size composition is highly charged and is able to be quickly adsorbed onto the fiber surfaces to permit efficient sizing in thin stock. The quick sizing avoids concern with rising pH over time and increases sizing efficiency.

The improved sizing agent, produced by pre-reacting the mixture into the papermaking furnish, wherein the alum is free to react with the rosin size without any competition from other cations, provides the highly charged nature of the sizing composition permitting efficient sizing via thin stock addition.

DESCRIPTION OF THE PREFERRED EMBODIMENT(S)

Figure 1:
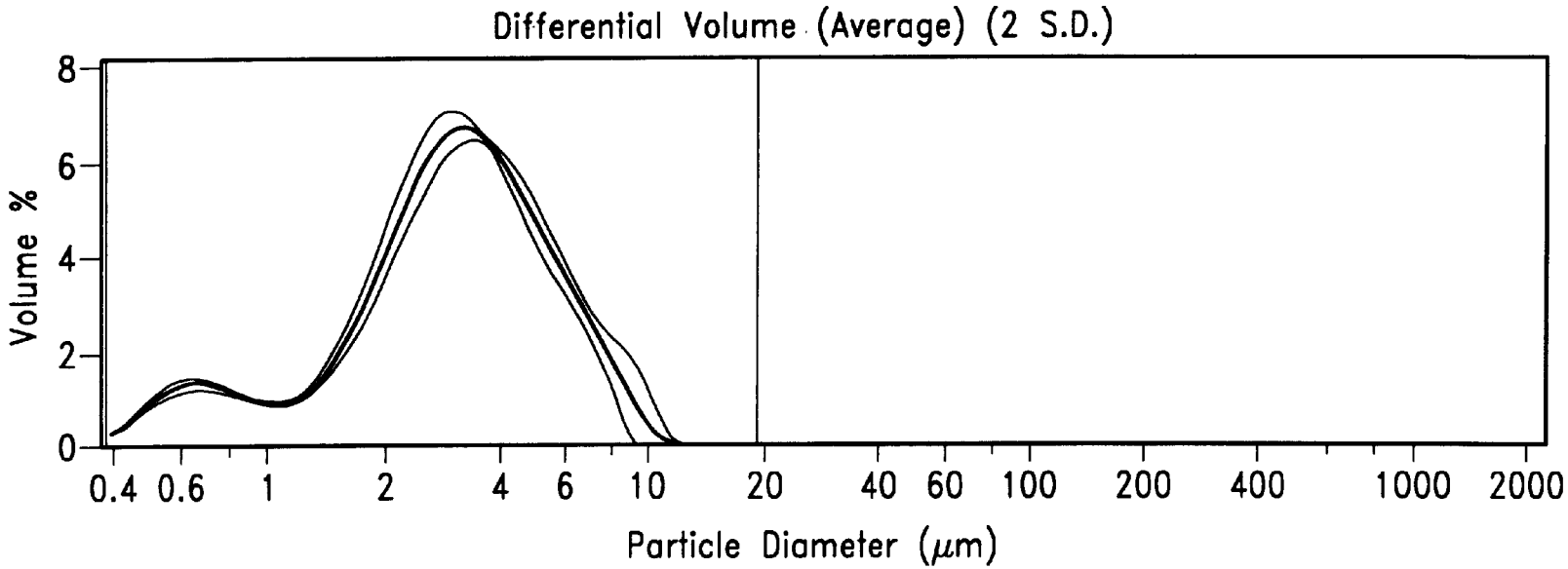
FIG. 1 is a graphic representation of the particle size distribution of a sample of the invention composition.
Figure 2:
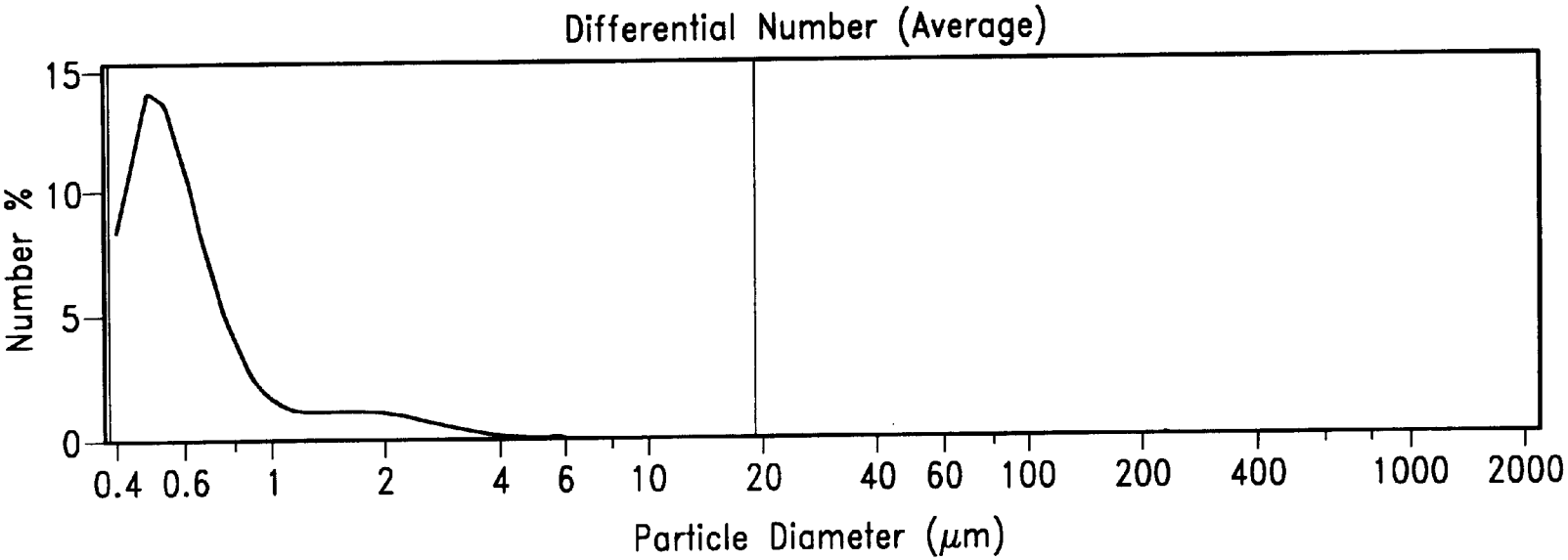
FIG. 2 is a graphical representation of the particle size of a sample of the invention composition.

It is known that the presence of calcium cations in a papermaking furnish will lower the sizing efficiency of a rosin or soap rosin sizing system. Inasmuch as the divalent calcium cations compete with the trivalent aluminum cations from the alum to complex with the rosin, calcium rosinate is not retained in the web as efficiently as aluminum rosinate, and sizing is lost. This competition is a particular problem when rosin or soap rosin size is added to the papermaking furnish before the alum, as in conventional sizing, and interacts with any multivalent cations present in the system.

The sizing problems described above can be overcome to some extent by using a reverse sizing technique. In reverse sizing the alum is added to the furnish before the rosin size. Thus, reverse sizing presents an improvement over conventional alum-rosin sizing, since the alum is in the furnish when the rosin size is added.

In accordance with the "parent" invention to that of the instant application, however, an even further improvement in sizing was taught to pre-react alum, either neat or in solution, and liquid soap rosin size before the mixture is added to the papermaking furnish. Using the pre-reaction technique, the alum is free to react with the rosin size without any competition from other cations in the system. It was further shown that an added effect of this pre-reaction technique, when conducted in a highly kinetic environment, is the production of rosin size material of a beneficial particle size.

EXAMPLE 1

This example shows a comparison of the sizing efficiency of three different sizing techniques. These tests are standard techniques used in the industry by those skilled in the art.

(1) Conventional sizing—add rosin, then add alum to the papermaking furnish.

(2) Reverse sizing—add alum, then add rosin to the papermaking furnish.

(3) Premixing—add rosin to alum, then add the mixture to the papermaking furnish.

Comparisons were made at 77° F. with a typical papermaking furnish having a hardness factor of 750 ppm. The data in Table 1 indicate that pre-reacting the alum and rosin produced a significant increase in sizing compared with both the conventional and reverse sizing methods, as determined by three tests: HST, Water Cobb, and Triton Cobb.

TABLE I

| Method | HST (sec) | Water Cobb ($g/m^2$) | Triton Cobb ($g/m^2$) |
|---|---|---|---|
| Conventional sizing | 16 | 166 | 197 |
| Reverse sizing | 23 | 150 | 203 |
| Premixing | 49 | 77 | 151 |

For each of the methods used, the papermaking furnish consisted of a blend of 10% pine, 40% hardwood, 50% broke, and cationic starch at 12 lb/ton. The handsheets tested had a basis weight of about 84 lbs/ream (ream size of 3000 sq. ft). For each condition, the sizing system comprised a 1.0% solution of STAFOR 50 rosin size (a product of Westvaco Corporation) and alum at an alum to rosin ratio of about 3 to 1.

As can be seen from the data in Table I, the premixing method produced the lowest sizing value, as determined by the Water Cobb and Triton Cobb tests, and the highest sizing value, as determined by the UST test. It should be noted that for the Cobb tests the lower numbers represent better sizing; whereas, for the HST test, higher numbers represent better sizing.

EXAMPLE 2

This example shows the effect of solution concentration on sizing efficiency for the pre-reaction of alum and rosin according to the present invention. Two different conditions were examined, at temperatures of 77° F. and 122° F. The results are shown in Table II.

TABLE II

| Temperature (° F.) | Concentration (%) | HST (sec) | Water Cobb ($g/m^2$) | Triton Cobb ($g/m^2$) |
|---|---|---|---|---|
| 77 | 0.1 | 173 | 38 | 72 |
| 77 | 1.0 | 49 | 77 | 151 |

TABLE II-continued

| Temperature (° F.) | Concentration (%) | HST (sec) | Water Cobb ($g/m^2$) | Triton Cobb ($g/m^2$) |
|---|---|---|---|---|
| 77 | 10.0 | 13 | 144 | 202 |
| 122 | 0.1 | 112 | 42 | 95 |
| 122 | 1.0 | 32 | 132 | 184 |
| 122 | 10.0 | 13 | 150 | 189 |

The data in Table II illustrate a preferential sizing treatment at the lowest solution concentration for each temperature condition. Specifically, the data show that internal sizing, as measured by HST, Water Cobb, and Triton Cobb tests at a concentration of 0.1%, was significantly better than that of the intermediate and higher concentrations. For example, as the concentration of the pre-reacted alum and size mixture was increased from 0.1% to 10%, internal sizing as measured by HST decreased from 173 seconds to 13 seconds.

EXAMPLE 3

This example developed data to determine the optimum alum to rosin ratio for the prereaction process of the "parent" invention. When using conventional sizing techniques, it was standard practice to add excess alum to the papermaking furnish to achieve complete precipitation of the rosin size. As an example, it was common to add alum in a 2.5 to 1 or greater ratio at the wet end of the paper machine. The alum/rosin sizing composition may be added in a ratio of 1–3:1. However, as shown by the data in Table III below, by prereacting the alum and rosin according to the present invention, the optimal ratio of alum to rosin was found to be about 1.5 to 1, according to the Triton Cobb test.

TABLE III

| Alum/Rosin (ratio) | Trinton Cobb ($g/m^2$) |
|---|---|
| 1:1 | 72 |
| 1.5:1 | 56 |
| 2:1 | 82 |
| 2.5:1 | 107 |

The data in Table III was generated from handsheets having a basis weight of 151 lbs/ream (ream size of 3000 $ft^2$), prepared from a furnish having a hardness factor of 500 ppm at a pH of 4.2 and ambient temperature (about 70° F.).

EXAMPLE 4

A further experiment was conducted to find the minimum hardness level at which the benefits of the pre-reacted alum/rosin size composition could be observed. In this experiment, handsheets were manufactured from a pulp blend consisting of 10% pine and 90% hardwood at a basis weight of 84 lbs/ream (ream size of 3000 ft.). The sizing system comprised an alum to rosin ratio of about 3 to 1 at a concentration of about 1%. Cationic starch, in an amount of 12 lbs/ton, was also added to the furnish. The hardness was varied from 0 to 75 ppm with the addition of calcium carbonate. The results are shown in Table IV.

TABLE IV

| Hardness (CC) (ppm) | Reverse Sizing Triton Cobb ($g/m^2$) | Premixing Triton Cobb ($g/m^2$) |
|---|---|---|
| 0 | 66 | 60 |
| 75 | 79 | 57 |
| 225 | 101 | 67 |
| 450 | 136 | 109 |
| 750 | 167 | 100 |

As shown by the data in Table IV, premixing and standard reverse sizing were found to produce substantially the same sizing values in a furnish with 0 ppm hardness. However, at a hardness level of 75 ppm, reverse sizing according to the Triton Cobb test increased to a value of 79 $g/m^2$ while the sizing achieved by premixing remained substantially the same at 57 $g/m^2$. Thus proved efficiency in sizing was observed beginning at a hardness level as low as this improvement continued up to the highest hardness level tested (750 ppm). It is believed that these results should be the same for furnishes having even higher hardness factors, and the results are believed to demonstrate the utility of the present invention in producing increased sizing efficiency in furnishes have a high hardness factor.

EXAMPLE 5

Figure 3:
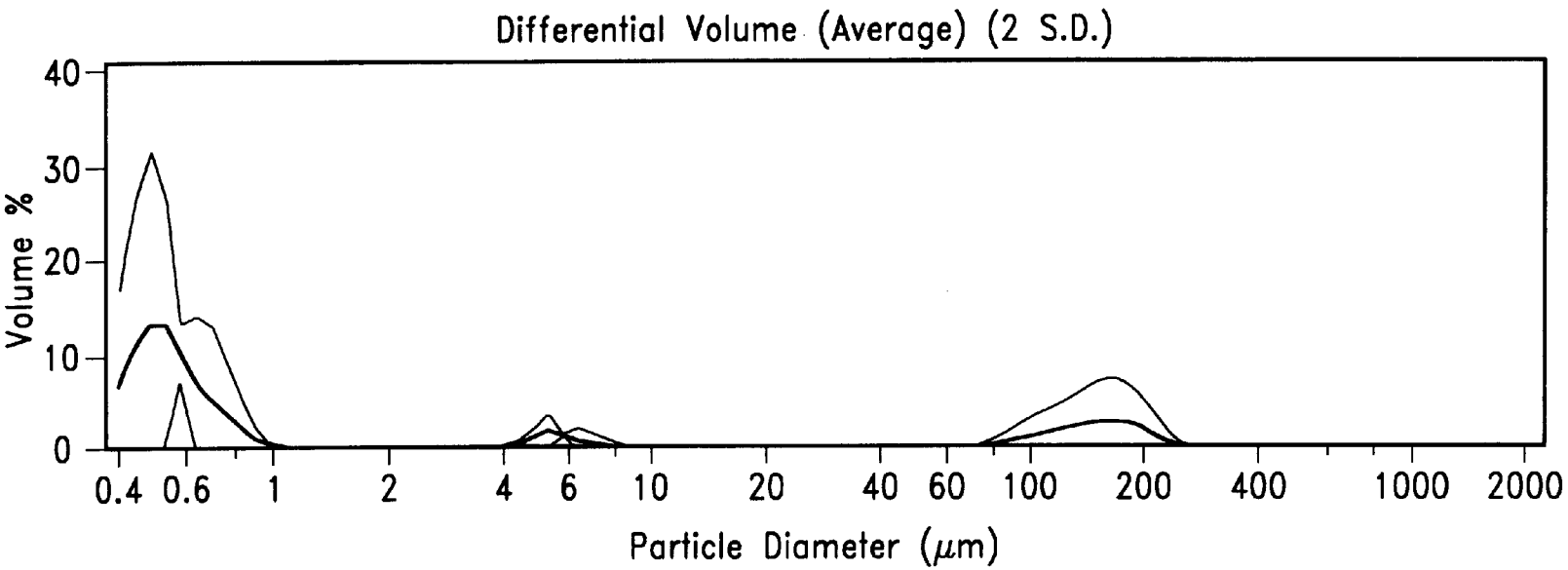
FIG. 3 is a graphical representation of the particle size distribution of a sample of a prior art composition.

A final study was conducted to measure the particle size of the pre-mixed alum/rosin composition. Scanning electron microscope photographs showed individual particle diameters in the range of about 0.1 to about 20 microns, with a mean particle diameter of less than 10. Two samples of the invention composition were analyzed for particle size using a Coulter LS Particle Size Analyzer. FIGS. 1 (sample #1) and 2 (sample #2) graphically depict the particle size distributions. For comparison purposes, the mean particle size of a standard, commercial premix cationic rosin size used for the manufacture of paper from Georgia Pacific, sold under the mark "NOVAPLUS," was similarly determined. FIG. 3 graphically depicts the particle size distribution for the prior art NOVAPLUS. Table V shows the average particle size diameters for up to less than 90% of each sample, as well as the calculated mean and median particle sizes for each sample.

TABLE V

| Sample # | <10% μm | <25% μm | <50% μm | <75% μm | <90% μm | mean μm | median μm |
|---|---|---|---|---|---|---|---|
| 1 | 0.976 | 2.007 | 3.009 | 4.383 | 6.063 | 3.342 | 3.009 |
| 2 | 0.418 | 0.466 | 0.555 | 0.711 | 1.201 | 0.729 | 0.555 |
| 3 | 0.426 | 0.481 | 0.585 | 5.642 | 152.6 | 32.19 | 0.585 |

The mean particle size of the NOVAPLUS composition sample (sample #3) was determined to be 32.19 microns, compared with no greater than 3.342 microns for the invention composition. It is theorized that the improved sizing efficiency achieved as shown in Example 4 is not only a result of the alum/rosin ratio but also is a result of the significantly smaller particle size (a mean particle size of ≦10 microns) of the invention size composition. A preferred mean particle size diameter range is from about 0.1 microns to about 5 microns and, more preferably, from about 0.5 microns to about 3.0 microns.

The alum/rosin size product for papermaking is pre-reacted for use in papermaking by injecting into a stream of water directed to a multiple of mixing chambers, in either order, a flow of rosin and a flow of alum for pre-reacting.

Figure 4:
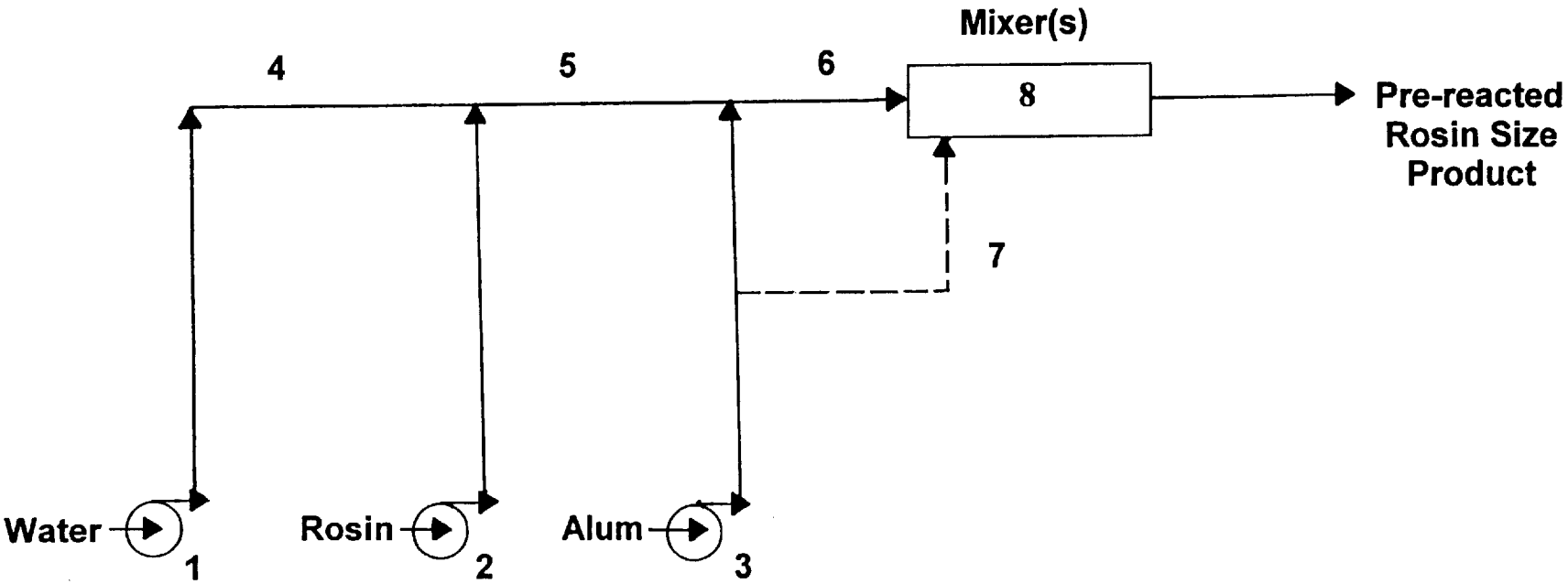
FIG. 4 is a process flow diagram for the manufacture of the invention composition.

One method for achieving the invention mean particle size is shown in FIG. 4, depicting the following steps:

(1) Water is pumped by a pump 1 from a source of said water to create a water stream 4 directed to a series of mixers or mixing chambers 8;

(2) Rosin, preferably in the form of liquid rosin soap, is pumped by a pump 2 from a source of said rosin and injected into water stream 4 to create a water/rosin stream 5;

(3) Alum is pumped by a pump 3 from a source of said alum and injected into water/rosin stream 5 to create a water/rosin/alum stream 6; and (4) Water/rosin/alum stream 6 enters mixers or mixing chambers 8 wherein the rosin and alum react under highly kinetic conditions to form a pre-reacted rosin size product for use in papermaking, which product is ejected from mixer or mixing chambers 8.

In an alternative embodiment of the above-described method, the injection point of the alum may be directly into the mixers or mixing chambers 8, via alum stream 7.

In an alternative embodiment of the above-described methods, the injection order of rosin and alum may be reversed.

The mixers or mixing chambers 8 may be selected from the group of ultrasonic mixers, homogenizers, turbines, rotor/stator configurations, both with recycle or without recycle, a mixture thereof, and one or more of these in senes.

The process of pre-forming the novel size composition may conveniently be arranged so as to interface with the normal processing of the papermaking furnish at the wet end of the paper machine. For the purpose of the present invention, a high hardness furnish is defined as one where the hardness factor is at least about 75 ppm, and preferably between about 75 and 750 ppm or higher. In the practice of the present invention, the alum to rosin ratio may vary from equal parts alum and rosin to as high as 3 parts alum to 1 part rosin, and preferably from about 1.5 parts alum to 1 part rosin. The solution concentration after mixing may range from about 0.05–10%, and preferably is about 0.1% for low pH furnishes. These ratios and preferred ranges may vary, depending upon the type of furnish and furnish pH.

The improvement more recently discovered involves the application of the "parent" application ('842) in papermaking. This '842 aluminum rosinate particle solution was taught as added to the thick stock at 4% consistency at the normal thick stock addition point, the machine chest at pH 4.8, in lieu of the conventional addition of soap size to the machine chest. The time of application in thick stock is typical of normal papermaking systems at about 20 minutes prior to headbox discharge. This is conventional practice soap size practice.

This initial '824 technology was to be practiced as an alternative to the conventional soap sizing application in the thick stock at pH 4.8. It is well known that the conventional application of soap size is commonly practiced in thick stock at pH 4.8 or less; and retention time of order of 20 minutes for maximum efficiency of size application in hot papermaking systems. The technology basis for this practice is related to the time dependency for the formation of the aluminum rosinate; and the adsorption of the charged aluminum rosinate particles on to the fiber surface in the thick stock system. The formation and adsorption of aluminum rosinate are time and consistency dependent phenomena.

The more efficient particle has been discovered to be capable of sizing in thin stock at about 0.5–1.5% consistency and at low retention times of less than one minute with equivalent sizing to thick stock application at pH 4.8. In this case the important feature of the '842 aluminum rosinate is the fact that it is a preformed aluminum rosinate; and can be added with a short retention time because it is highly charged and should be quickly adsorbed onto the fiber surface to provide sizing in thin stock.

The present invention relates to a paper sizing process comprising the steps of:

(a) blending a cellulosic fiber papermaking headbox thin stock furnish with an internal sizing formulation comprising particles of an alum/liquid rosin soap blended material characterized by a mean particle size of no greater than 10 microns and an alum to rosin ratio of about 1–3:1 (as disclosed in parent application '842;

(b) forming an internally sized paper web from said blend;

(c) drying said internally sized paper web to produce a paper product having a water extractable pH level of from about 4.0 to below 6.0.

The thin stock furnish is at about 0.5–1.5% consistency, preferably at about 0.75–1.25% consistency, and most preferably at about 1% consistency.

Alternatively, the sized paper web is not completely dried and is treated with a surface size formulation suitable to the intended use of the paper product, followed by more complete drying. It is desirable that any retained moisture of the paper web, if extracted therefrom, exhibits a pH from about 4.0 to less than 6.0.

The following tests reported in these additional examples provide a comparison of thick stock sizing, using commercial rosin size, versus thin stock sizing the '842 alum/rosin size composition with thin stock sizing at pH 4.0.

EXAMPLE 6

| Sizing Mode | % Size Agent on Rosin Basis | Triton Cobb |
|---|---|---|
| | 16 Point Printkote | |
| STAFOR ®* (thick) | 0.41 | 152 |
| 842 Comp. (thin) | 0.41 | 151 |
| | 12 Point Printkote | |
| STAFOR ®* (thick) | 0.46 | 155 |
| STAFOR ®* (thick) | 0.53 | 177 |
| 842 Comp. (thin) | 0.48 | 162 |

*Commercial rosin size manufactured and marketed by Westvaco Corporation

It is known that the efficiency of aluminum rosinate thick stock addition is pH dependent. In thick stock sizing at pH higher than 4.8 with at least 20 minutes retention time, the sizing efficiency is reduced as the pH is increased up to pH 6.5. Here, after formation of aluminum rosinate, the charge on the aluminum rosinate is reduced with the time exposure at high pH during the normal 20 minute lag time for thick stock addition of soap size.

The successful application of the '842 aluminum rosinate in thin stock at less than one minute retention time at pH 4.8 provides the potential to reduce the time exposure of the aluminum rosinate to elevated pH conditions. Thus, one should be able to size with the '842 aluminum rosinate in thin stock at elevated pH and elevated temperatures with at least as equivalent efficiency compared to thick stock sizing at pH 4.8.

Additional examples are provided to show the ability to achieve equal or better sizing via thin stock addition using the '842 alum/rosin size composition at higher (than 4.8) pH as sizing with a standard commercial size via thick stock addition at pH 4.8.

EXAMPLE 7

| Folding Carton Stock - Size added based on Rosin @ 5 lbs/Ton | | | |
|---|---|---|---|
| | HST | Cobb | Al + 3 Residual |
| STAFOR ®* | 61 | 42 | 0.75 |
| '824 Comp.** | 60 to 79 | 40 to 44 | 0.35 to 0.50 |

*Control: STAFOR ® at pH 4.8 in Thick Stock (Alum 15 lbs/Ton)
**'824 Composition
Alum to Size in always 1:1
pH whitewater from 5.8 to 6.1
Thick stock alum from 0 to 15 lbs/Ton

| Folding Carton Stock - Size added based on Rosin @ 10 lbs/Ton | | | |
|---|---|---|---|
| | HST | Cobb | Al + 3 Residual |
| STAFOR ®* | 138 | 34 | 0.75 |
| 842 Comp.** | 137 to 153 | 31 to 34 | 0.50 to 0.75 |

*Control: STAFOR ® at pH 4.8 in Thick Stock (Alum 20 lbs/Ton 0
**842 Composition
Alum to Size in always 1:1
pH whitewater = 5.4
Thick stock alum from 0 to 5 lbs/Ton That which the inventors consider to be the subject matter of this invention is:

(1) A paper sizing process comprising the steps of:
- (a) blending a cellulosic fiber papermaking headbox thin stock furnish with an internal sizing formulation comprising particles of an alum/liquid rosin soap blended material characterized by a mean particle size of no greater than 10 microns and an alum to rosin ratio of about 1–3:1;
- (b) forming an internally sized paper web from said blend;
- (c) drying said internally sized paper web to produce a paper product having a water extractable pH level of from about 4.0 to below 6.0.

(2) The paper sizing process of (1) wherein the paper web of step (c) is dried to a moisture content of less than 10%, followed by the additional steps of:
- (d) coating said paper web on at least one side thereof with a surface sizing formulation; and
- (e) drying said surface sized paper web to a moisture content of 7% or less to produce a paper product having a water extractable pH level of from about 4.0 to below 6.0.

(3) The paper sizing process of (1) wherein the internal sizing formulation is further characterized by an alum/liquid rosin soap ratio of about 1 part alum to about 1 part rosin and the mean particle size is from about 0.1 microns to about 5.0 microns.

(4) The paper sizing process of (1) wherein the internal sizing formulation is further characterized by an alum/liquid rosin soap ratio of about 1.5 parts alum to about 1 part rosin and the mean particle size is from about 0.5 microns to about 3.0 microns.

(5) The paper sizing process of (1) wherein the thin stock furnish is characterized by a consistency from about 0.5 to about 1.5.

(6) The paper sizing process of (5) wherein the thin stock furnish is characterized by a consistency from about 0.75 to about 1.25.

(7) The paper sizing process of (6) wherein the thin stock furnish is characterized by a consistency from about 1.0.

While the preferred method for carrying out the process of the present invention has been described herein in some detail, it will be understood that numerous variations may be made in carrying out the process, and in the construction and arrangement of equipment for carrying out the process, without departing from the general spirit and scope of the invention. Accordingly, the breadth of the present invention should only be limited by the scope and content of the appended claims.

We claim:

1. A paper sizing process comprising the steps of:
- (a) blending a cellulosic fiber papermaking headbox thin stock furnish with an internal sizing formulation comprising particles of an alum/liquid rosin soap blended material characterized by a mean particle size of no greater than 10 microns and an alum to rosin ratio of about 1–3:1;
- (b) forming an internally sized paper web from said blend;
- (c) drying said internally sized paper web to produce a paper product having a water extractable pH level of from about 4.0 to below 6.0.

2. The paper sizing process of claim 1 wherein the paper web of step (c) is dried to a moisture content of less than 10%, followed by the additional steps of:
- (d) coating said paper web on at least one side thereof with a surface sizing formulation; and
- (e) drying said surface sized paper web to a moisture content of 7% or less to produce a paper product having a water extractable pH level of from about 4.0 to below 6.0.

3. The paper sizing process of claim 1 wherein the internal sizing formulation is further characterized by an alum/liquid rosin soap ratio of about 1 part alum to about 1 part rosin and the mean particle size is from about 0.1 microns to about 5.0 microns.

4. The paper sizing process of claim 1 wherein the internal sizing formulation is further characterized by an alum/liquid rosin soap ratio of about 1.5 parts alum to about 1 part rosin and the mean particle size is from about 0.5 microns to about 3.0 microns.

5. The paper sizing process of claim 1 wherein the thin stock furnish is characterized by a consistency from about 0.5 to about 1.5.

6. The paper sizing process of claim 5 wherein the thin stock furnish is characterized by a consistency from about 0.75 to about 1.25.

7. The paper sizing process of claim 6 wherein the thin stock furnish is characterized by a consistency from about 1.0.

* * * * *

UNITED STATES PATENT AND TRADEMARK OFFICE

CERTIFICATE OF CORRECTION

PATENT NO. : 6,540,877 B1
DATED : April 1, 2003
INVENTOR(S) : Gerald Katz et al.

It is certified that error appears in the above-identified patent and that said Letters Patent is hereby corrected as shown below:

Column 6,
Line 20, after "as low as" insert therefor -- 75 ppm, and --.

Column 7,
Line 56, delete "'824" and insert therefor -- '842 --.

Column 9,
Example 7, lines 15 and 17, delete "'824" and insert therefor -- '842 --.

Signed and Sealed this

Twelfth Day of August, 2003

JAMES E. ROGAN
*Director of the United States Patent and Trademark Office*